US008002956B1

(12) United States Patent
O'Connor et al.

(10) Patent No.: US 8,002,956 B1
(45) Date of Patent: Aug. 23, 2011

(54) PLATING STAND-OFF

(75) Inventors: Timothy J O'Connor, Troy, NY (US); Frederick J Nelson, Schenectady, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 847 days.

(21) Appl. No.: 12/038,941

(22) Filed: Feb. 28, 2008

(51) Int. Cl.
*C25B 9/00* (2006.01)
*C25D 17/00* (2006.01)

(52) U.S. Cl. ..... 204/279; 204/280; 204/286.1; 204/288; 204/288.1; 204/288.4; 204/297.01; 204/297.15

(58) Field of Classification Search ..... 204/279, 204/280, 286.1, 288, 288.1, 288.4, 297.01, 204/297.15
See application file for complete search history.

(56) References Cited

U.S. PATENT DOCUMENTS

| | | | | |
|---|---|---|---|---|
| 3,711,955 | A * | 1/1973 | Holt | 33/661 |
| 3,962,066 | A * | 6/1976 | Barber et al. | 204/279 |
| 4,595,475 | A * | 6/1986 | Pawlek et al. | 204/247.4 |
| 6,790,113 | B1 * | 9/2004 | Fujita | 445/7 |
| 2007/0267953 | A1 * | 11/2007 | Seki | 313/292 |
| 2008/0011615 | A1 * | 1/2008 | Omtveit | 205/777 |

* cited by examiner

*Primary Examiner* — Bruce F Bell
(74) *Attorney, Agent, or Firm* — John F. Moran

(57) ABSTRACT

A stand-off for maintaining the separation between an electrode and an object during a flow-through electroplating process is disclosed. The stand-off comprises a substantially streamlined shape that mitigates the effects of shadowing during deposition.

14 Claims, 3 Drawing Sheets

PLATING STAND-OFF

UNITED STATES GOVERNMENT INTEREST

The inventions described herein may be manufactured, used and licensed by or for the U.S. Government for U.S. Government purposes.

FEDERAL RESEARCH STATEMENT

The inventions described herein may be made, used, or licensed by or for the United States Government for government purposes without payment of any royalties thereon or therefore.

FIELD OF THE INVENTION

This invention relates generally to the field(s) of electro-chemical deposition and, more particularly to electroplating technology.

BACKGROUND OF THE INVENTION

Electro-chemical deposition processes are used to deposit materials on exposed surfaces of objects. Electro-plating is one well-known electro-chemical deposition process. To plate an object using an electro-plating process, the object and an electrode are placed in a bath of electroplating solution. The electrode is placed in proximity to the object to be plated and a voltage is applied between the electrode and the object. In the presence of the electric field, current flows through the electroplating solution and a chemical reaction occurs, the result of which is the deposition of the plating material on the object. Electro-plating is a commonly-used process for applying a layer of metal to an object.

To increase their lifetime, the interior surface of gun-barrels, such as those used in artillery pieces and tanks, are often coated with chromium using a "flow-through" electro-plating process. In order to coat the interior surface of a gun barrel, a copper electrode (of the appropriate diameter with respect to the center bore of the gun barrel) is inserted into the barrel during plating. Electroplating solution is flowed through the region between the electrode and the barrel while a voltage is applied between the electrode and the barrel. In the presence of the applied voltage, a current flows through the electroplating solution and chromium deposits on the interior surface of the gun barrel.

Conventional hard-chromium is electroplated using electric current of approximately 6,000 amperes. Low-contraction (LC) chromium, however, is highly desirable in many applications, including for coatings of gun barrel interiors. Unfortunately, the plating of LC chromium requires the use of a much higher current—as high as 48,000 amperes. The electric field associated with the electroplating of LC chromium induces a substantial mechanical force between the electrode and the gun barrel. As a result of this force, the electrode can bends to one side and electrically short to the gun barrel. Even if the electrode does not short to the gun barrel, however, the bending effect results in an uneven deposition of chromium on the gun barrel.

In an effort to eliminate bending of the electrode, stand-offs are inserted into the electrode. These stand-offs are installed both radially and axially along the length of the electrode, and provide a mechanical "stop" that helps maintain the separation between the electrode and the interior surface of the gun barrel. While these stand-offs do reduce the bending of the electrode, they interfere with the flow of electroplating solution through the length of the gun barrel. Due to flow effects, such as stagnation and eddying, the stand-offs cause a "shadowing" effect that reduces the plating thickness near the locations of the stand-offs.

Methods and apparatus which mitigate the problems associated with bending of the electrode while reducing the shadowing effect, is therefore desirable.

SUMMARY OF THE INVENTION

An advance is made in the art according to the principles of the present invention directed to a stand-off and electrode for use in electroplating systems—particularly electroplating systems that utilize high electric current and/or high electric fields during the coating process. The present invention is particularly well-suited for use in flow-through low-contraction chromium electroplating systems. In some embodiments, each of a plurality of stand-offs has a first end that is threaded. This threaded portion mates to any of a plurality of holes located in the electrode. Each of the plurality of stand-offs also has a second end that tapers to a small point wherein it may contact the inside surface of the object to be coated. In addition, each stand-off includes a body portion, between the first and second end, that is substantially streamlined for the direction of electroplating solution flow during the electroplating process. As a result, the present invention provides in an improvement in coverage uniformity as compared to electroplating systems known in the prior-art.

DETAILED DESCRIPTION

Figure 1:
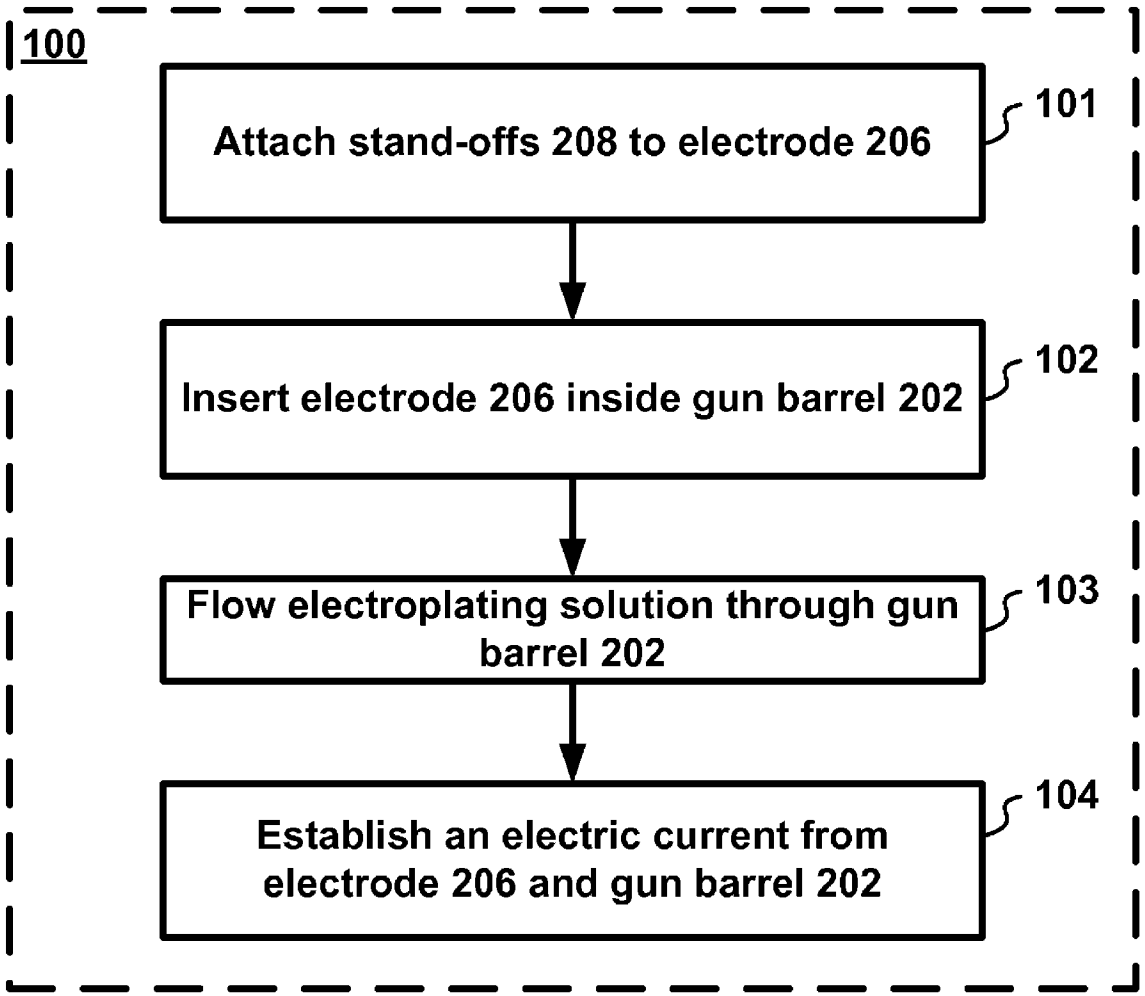
FIG. 1 depicts a method for plating the inner wall of an object in accordance with an illustrative embodiment of the present invention.

FIG. 1 depicts a method for plating the inner wall of an object in accordance with an illustrative embodiment of the present invention. Method 100 is particularly suitable for electro-chemical deposition of low-contraction chromium on the inside of a cylindrical object, such as a gun barrel. Method 100 is described below with reference to FIGS. 2A-2B and FIGS. 3A-3C.

Figure 2A:
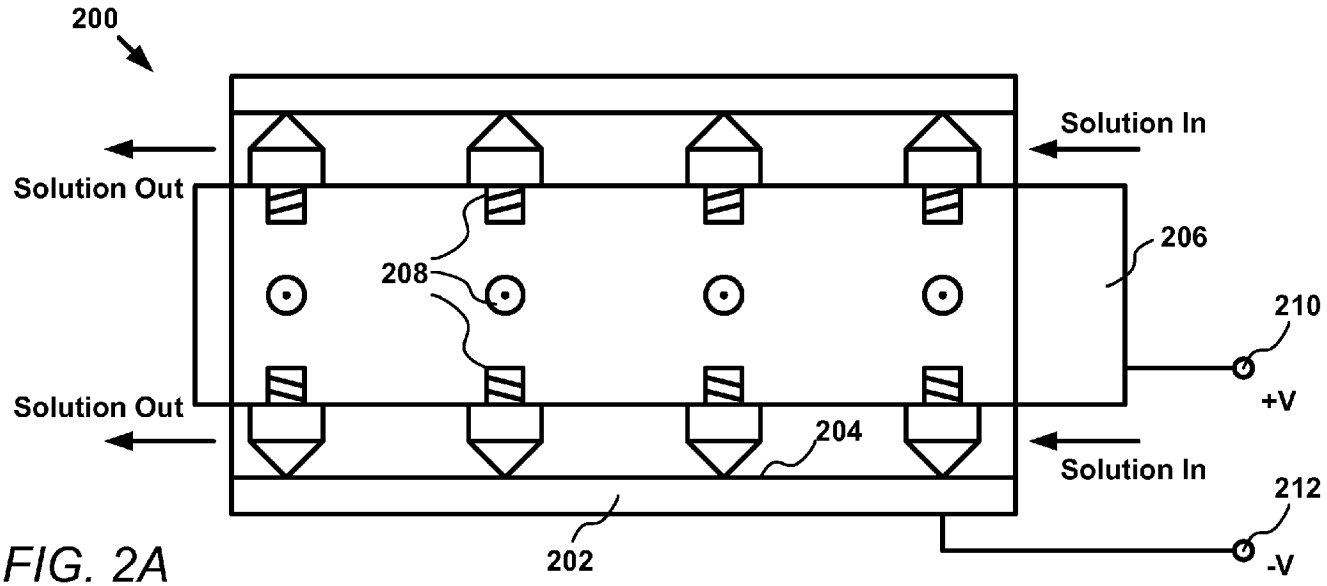
FIG. 2A depicts a cross-sectional side view of an electroplating system in accordance with the illustrative embodiment of the present invention.
Figure 2B:
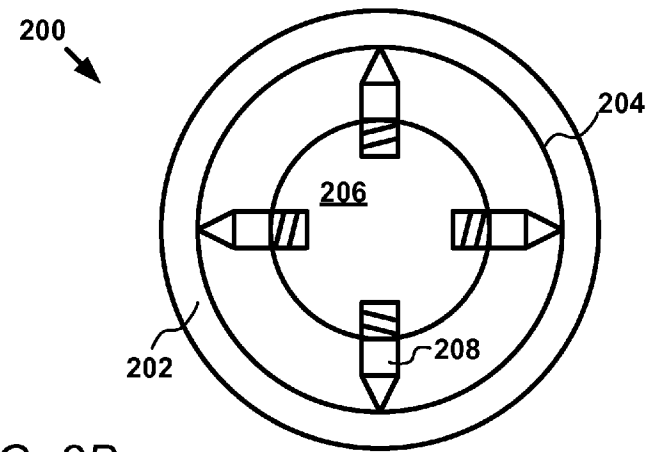
FIG. 2B depicts an end view of an electroplating system in accordance with the illustrative embodiment of the present invention.

FIGS. 2A and 2B depict a cross-sectional side view and end view (respectively) of an electroplating system in accordance with the illustrative embodiment of the present invention. Electroplating system 200 is suitable for plating the inside surface of objects, such as the inner wall of a gun barrel. Electroplating system 200 comprises object 202, electrode 206, stand-offs 208, and terminals 210 and 212.

Object 202 is a gun barrel that comprises an electrically conductive, metallic cylinder having inner wall 204 and a center bore. The center bore and wall thickness of object 202 are suitable for launching a projectile, such as an artillery shell. In some embodiments, inner wall 204 is an electrically-conductive layer that is bonded to a cylinder comprising a material that is not electrically conductive. In some embodiments, object 202 is an object other than a gun barrel and comprises a shape that is different than a cylinder. It will be clear to those skilled in the art how to make and use object 202.

Method 100 begins with operation 101, wherein stand-offs 208 are attached to electrode 206.

Electrode 206 is a copper rod having a diameter appropriate for the center bore of object 202. Electrode 206 comprises a plurality of threaded holes for receiving a plurality of stand-offs 208. The threaded holes are arrayed on the surface of electrode 206 in a pattern that has a radial and a longitudinal component. The pattern of the threaded holes is suitable for providing adequate support between electrode 206 and object 202 when a high electric field is induced between them. In some embodiments, electrode 206 acts as an anode during the process of electroplating. Although the illustrative embodiment comprises a plurality of stand-offs wherein the stand-offs are arranged at 90 degree increments around the circumference of electrode 206, it will be clear to those skilled in the art, after reading this specification, how to make and use alternative embodiments of the present invention wherein a plurality of stand-offs are arranged in any manner suitable to maintain the relative position between electrode 206 and inner surface 204 in the presence of an applied electric field associated with the process of electro-chemical deposition.

Stand-offs 208 are mechanically rigid supports that provide support between electrode 206 and object 202 during the process of electroplating. Stand-offs 208 are shaped to be substantially streamlined in the direction of the flow of solution through the region between electrode 206 and object 202. In other words, the shape of stand-off 208 is designed to provide minimal perturbation to the flow of electroplating solution through the gap between electrode 206 and object 202. Stand-offs 208 comprise a material that is: (1) electrically insulating so that the stand-offs are capable of withstanding electric fields associated with electroplating without exhibiting electrical breakdown; and (2) substantially chemically inert with respect to the solution used for electroplating object 202. Suitable materials for stand-off 208 include, without limitation, ceramics, high-density plastics, and glass. In some embodiments, stand-offs 208 comprise a material that degrades slightly during the process of electroplating. Stand-off 208 is described in more detail below and with respect to FIGS. 3A-3C. The specific positions of stand-offs 208 along electrode 206 is a matter of design choice. The positions are selected, however, to ensure that the physical relationship between electrode 206 and object 202 remains substantially fixed during the process of electroplating.

In some embodiments, stand-offs 208 comprise alternative connective elements to screw threads, such as swage fittings, pressure fittings, etc. It will be clear to those of ordinary skill in the art, after reading this specification, how to make and use alternative embodiments of the present invention wherein stand-offs 208 are attached to electrode 206 using connective elements other than screw threads.

At operation 102, electrode 206, with attached stand-offs 208, is inserted into the center bore of object 202.

At operation 103, electroplating solution is flowed through the cavity between electrode 206 and inner surface 204. The direction of the flow of electroplating solution is a matter of design choice, and in some embodiments of the present invention the flow is opposite that shown in FIG. 2A.

Terminals 210 and 212 are electrical terminals suitable for introducing the electrical voltages and currents associated with the process of electroplating. Terminal 210 is electrically connected to electrode 206, and terminal 212 is electrically connected to electrically conductive inner wall 104 of object 202. In some embodiments, terminal 212 is electrically connected to inner wall 104 through the thickness of the sidewall of object 202. In some embodiments, terminals 210 and 212 are suitable for carrying electric currents as high as 50,000 amperes.

At operation 104, a voltage differential is applied across terminals 210 and 212. As a result, a flow of electric current is established through a path that includes terminal 210, electrode 206, the electroplating solution, inner surface 204, and terminal 212. In some embodiments, the magnitude of the established electric current is as high as 50,000 amperes.

Figure 3C:
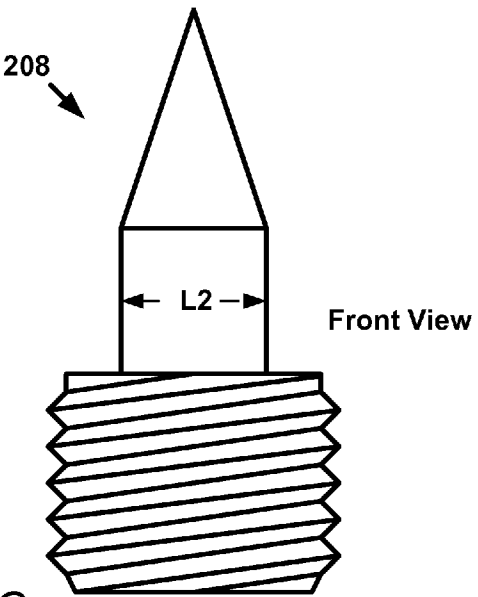
FIG. 3C depicts a front view of details of a stand-off in accordance with the illustrative embodiment of the present invention.
Figure 3B:
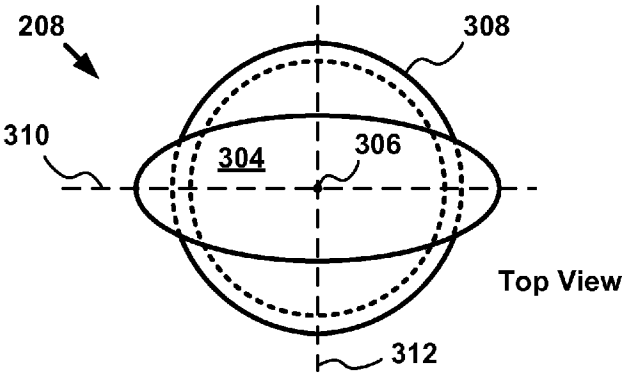
FIG. 3B depicts a top view of details of a stand-off in accordance with the illustrative embodiment of the present invention.
Figure 3A:
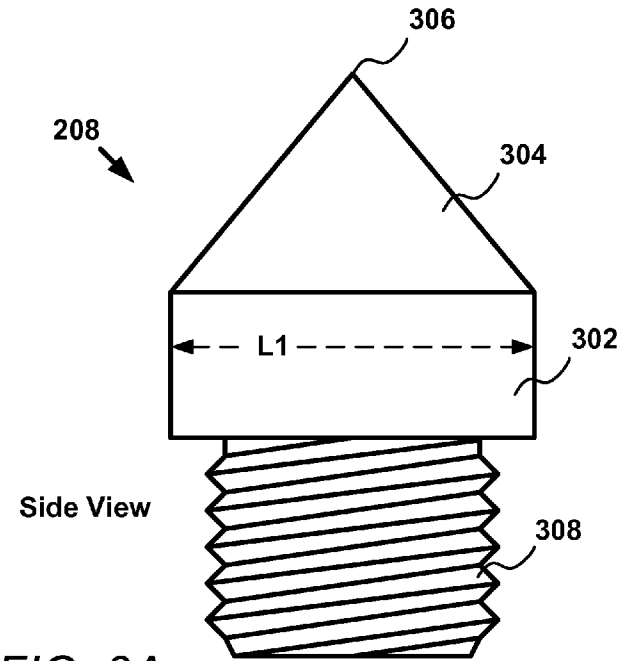
FIG. 3A depicts a side view of details of a stand-off in accordance with the illustrative embodiment of the present invention.

FIGS. 3A, 3B, and 3C depict a side view, top view, and front view (respectively) of details of a stand-off in accordance with the illustrative embodiment of the present invention. Stand-off 208 comprises body 302, cone 304, and threaded portion 308.

Body 302 is a structural element that has an elliptical cross-section having length L1 along its major axis, and length L2 along its minor axis. In some embodiments, length L1 is within the range of approximately 0.5 inches to approximately 2 inches. In some embodiments, L1 is approximately 1 inch. In some embodiments, length L2 is within the range of approximately 0.25 inches to approximately 1 inch. In some embodiments, L2 is approximately 0.5 inches. The value of lengths L1 and L2 is a matter of design, and is influenced by the magnitude of the voltage applied to terminals 210 and 212, the desired separation between electrode 206 and inner surface 204, and the flow rate of electroplating solution through the region between electrode 206 and inner surface 204.

Cone 304 is a tapered structural element whose cross-section transitions in size from that of the cross-sectional shape of body 302 to point 306. In some embodiments, the height of cone 304 is within the range of approximately 0.5 inches to approximately 2 inches. In some embodiments, the height of cone 304 is approximately 1 inch. The shape of cone 304 is a matter of design; however, cone 304 should provide: (1) sufficient mechanical stability in the presence of the electric field associated with the process of electroplating; and (2) be able to withstand the force associated with the flow of electroplating solution.

The shape of body 302 and cone 304 is chosen to provide a substantially streamlined shape for the flow of electroplating solution. As a result of the shape of body 302 and cone 304, electroplating solution does not become substantially depleted behind stand-off 208 (relative to the direction of the flow) due to stagnation or eddying of the fluid.

Threaded portion 308 comprises a thread that is suitable for mating to the threaded holes located on electrode 206.

It is to be understood that the above-described embodiments are merely illustrative of the instant invention and that many variations of the above-described embodiments can be devised by those skilled in the art without departing from the scope of the invention. For example, in this Disclosure, numerous specific details are provided in order to provide a thorough description and understanding of the illustrative embodiments of the instant invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the disclosure to "one embodiment" or "an embodiment" or "some embodiments" means that a particular feature, structure, material, or characteristic described in connection with the embodiment(s) is included in at least one embodiment of the instant invention, but not necessarily all embodiments. Consequently, the appearances of the phrase "in one embodiment," "in an embodiment," or "in some embodiments" in various places throughout the Disclosure are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. A stand-off for attaching to an electrode, wherein the stand-off comprises a first portion having an elliptical cross-section and a second portion that tapers from the first portion to end as a point.

2. The stand-off of claim 1 further comprising a third portion, wherein the third portion comprises a physical-adaptation for attaching to the electrode.

3. The stand-off of claim 2 wherein the physical-adaptation comprises screw threads.

4. The stand-off of claim 2 wherein the physical-adaptation comprises a swage fitting.

5. The stand-off of claim 2 wherein the physical-adaptation comprises a pressure fitting.

6. The stand-off of claim 1 wherein the stand-off comprises a material that is an electrical insulator.

7. The stand-off of claim 1 wherein the stand-off comprises a material that is stable in the presence of an electroplating solution.

8. The stand-off of claim 1 further comprising the electrode.

9. The stand-off of claim 1 wherein the major and minor axes of the elliptical cross-section provide a substantially streamlined shape for a flow of an electroplating solution.

10. A stand-off comprising a threaded portion, a body portion, and a conical portion, and wherein the body portion interposes the threaded portion and the conical portion, and further wherein the stand-off comprises a material that is an electrical insulator.

11. The stand-off of claim 10 further comprising an electrode, wherein the electrode comprises a threaded hole, and wherein the threaded hole is physically-adapted to receive the threaded portion.

12. The stand-off of claim 10 wherein the stand-off comprises a material that is substantially chemically-inert with an electroplating solution.

13. The stand-off of claim 10 wherein the body portion has an elliptical cross-section.

14. The stand-off of claim 10 further comprising an electrode having a longitudinal axis, wherein the body portion has an elliptical cross-section, and wherein the electrode receives the stand-off so that the longitudinal axis and the major axis of the elliptical cross-section are substantially aligned.

* * * * *